US005404821A

United States Patent [19]

Bond

[11] Patent Number: 5,404,821

[45] Date of Patent: Apr. 11, 1995

[54] PALLET HAVING POSTS WITH JACK SCREW LOCK

[76] Inventor: Irvin D. Bond, 10270 Allen Rd., Clarkston, Mich. 48016

[21] Appl. No.: 205,368

[22] Filed: Mar. 4, 1994

[51] Int. Cl.[6] ..... B65D 19/44

[52] U.S. Cl. ..... 108/55.1; 108/56.3

[58] Field of Search ..... 108/55.1, 55.3, 54.1, 108/51.1, 56.3

[56] References Cited

U.S. PATENT DOCUMENTS 4,915,033 4/1990 Bond ..... 108/55.1
4,977,836 12/1990 Bond ..... 108/55.1
5,297,485 3/1994 Bond ..... 108/54.1

FOREIGN PATENT DOCUMENTS 1479364 5/1989 U.S.S.R. ..... 108/55.1

*Primary Examiner*—Kenneth J. Dorner
*Assistant Examiner*—Gerald D. Anderson
*Attorney, Agent, or Firm*—Charles W. Chandler

[57] ABSTRACT

A pallet having several vertical posts for maintaining a plurality of sheet metal parts in a stacked position. Each post is horizontally mounted on the pallet base and locked in position by a jack screw arrangement.

8 Claims, 3 Drawing Sheets

PALLET HAVING POSTS WITH JACK SCREW LOCK

CROSS-REFERENCE TO RELATED APPLICATIONS

This application is related to my U.S. patent application Ser. No. 08/005,733, entitled PALLET HAVING ADJUSTABLE LOAD LOCATOR POSTS, filed Jan. 19, 1993

BACKGROUND OF THE INVENTION

This invention relates to a pallet for supporting a plurality of sheet metal stampings or other parts in a stacked condition on a pallet base. Vertical posts having their lower ends locked to the pallet base, engage the edges of the stacked parts. The position of each post can be horizontally adjusted to accommodate the shape of the parts.

Pallets having horizontally adjustable posts are known in the art. Various mechanical arrangements have been employed for locking the lower end of each post to the pallet base so that the post can be adjusted according to the shape and location of the stacked parts. The posts prevent the parts from shifting from their stacked position. Such locator posts are illustrated in my U.S. Pat. No. 4,915,033, issued Apr. 10, 1990, for "Parts Stacking Pallet"; my U.S. Pat. No. 4,977,836, issued Dec. 18, 1990, for "Parts Stacking Pallet" as well as my co-pending patent application.

SUMMARY OF THE INVENTION

The broad purpose of the present invention is to provide an improved pallet and post arrangement for supporting similarly shaped parts, such as sheet metal stampings, in a stacked configuration. The pallet has a base with several horizontal tracks for supporting the vertical posts. Each track has a top opening slot.

Each post has an elongated plunger slideably mounted in the lower end of the post. A cap screw is threadably mounted to the lower end of the plunger. A collar is attached to the lower end of the post. The collar has a width greater than the slot in the track. The lower end of the post with the collar and the cap screw are inserted in the channel.

A handle is pivotally mounted on the post and connected by a link to the plunger. Raising the handle raises the plunger and the cap screw from the bottom of the channel. When the user lowers the handle, the plunger is lowered until the cap screw engages the base of the track. Then the post body is raised to engage the underside of the tracks top wall, wedging the post in position. The cap or jack screw can be adjusted to accommodate differences in the track depth.

The preferred post and pallet assembly is relatively easy to insert or remove from the track, easy to release or lock in position and requires a relatively few, easily manufactured components.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE DRAWINGS

Figure 1:
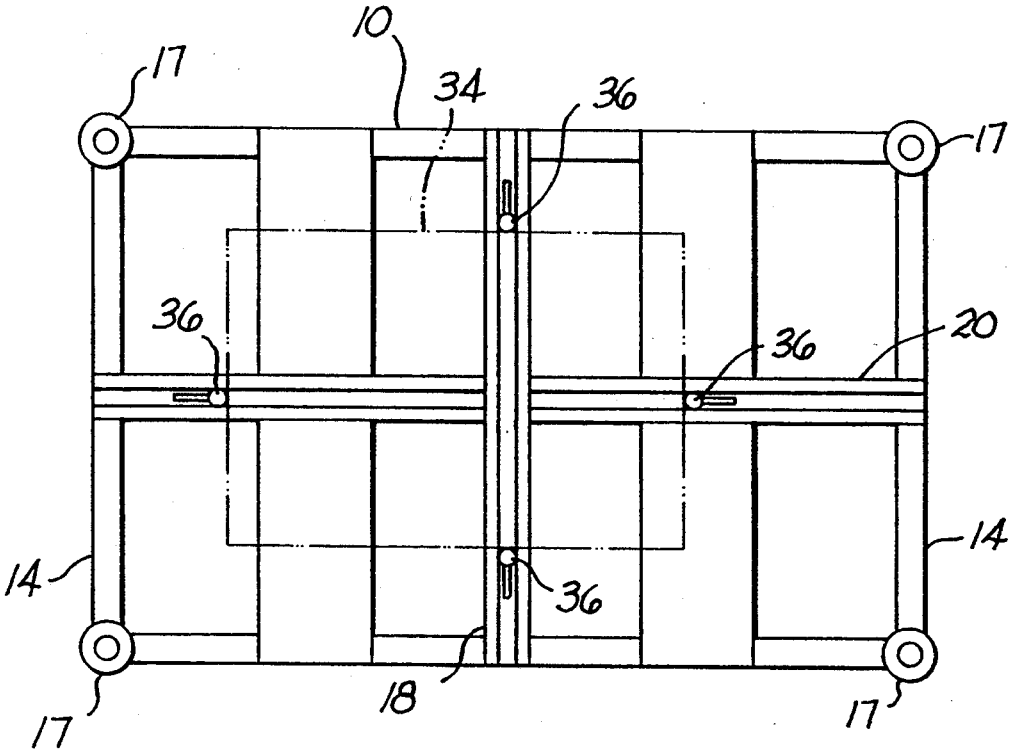
FIG. 1 is a top plan view of a pallet illustrating the preferred embodiment of the invention.
Figure 2:
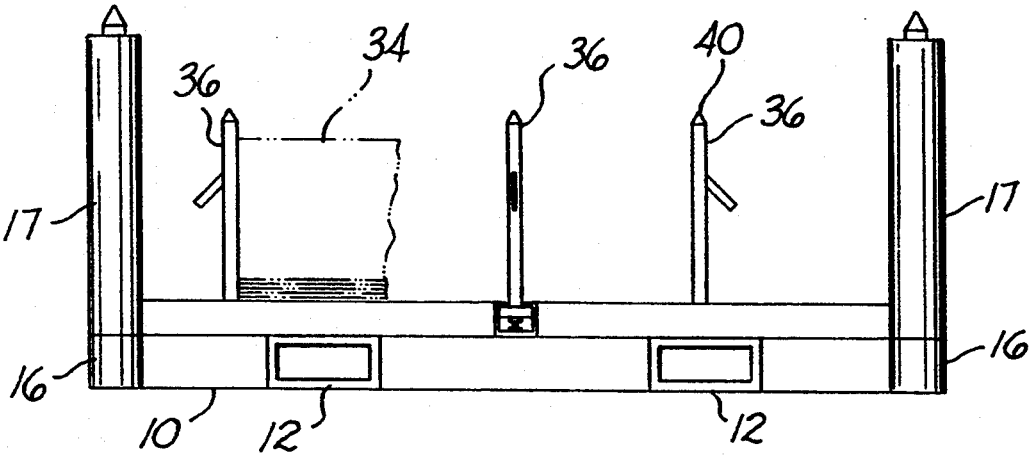
FIG. 2 is an elevational view of the pallet of FIG. 1.

Referring to the drawings, FIGS. 1 and 2 illustrate a parts stacking pallet 10, formed with a pair of laterally spaced steel tubes 12 welded or otherwise secured to a series of steel frame elements 14. The corners of the pallet have short vertical tubes 16 welded to frame elements 14 to form sockets designed to removably receive the lower ends of corner posts 17. Posts 17 are used primarily for stacking one pallet above the other.

Steel tubes 12 are spaced the same distance as the arms on a conventional lift truck. The truck inserts its prongs into tubes 12, to raise and move the pallet and its contents to a different location.

The load bearing surface of the pallet is defined by channel-shaped tracks 18 and 20 which are welded to the upper surfaces of tubes 12 and frame elements 14. Each track has the channel-shaped configuration illustrated in FIG. 5. The track has a base wall 22 and a pair of vertical side walls 24 and 26. The upper edges of the side walls are bent to form lips 28 and 30, which are spaced to form slot 32. Slot 32 is horizontal and extends the length of the track.

Figure 4:
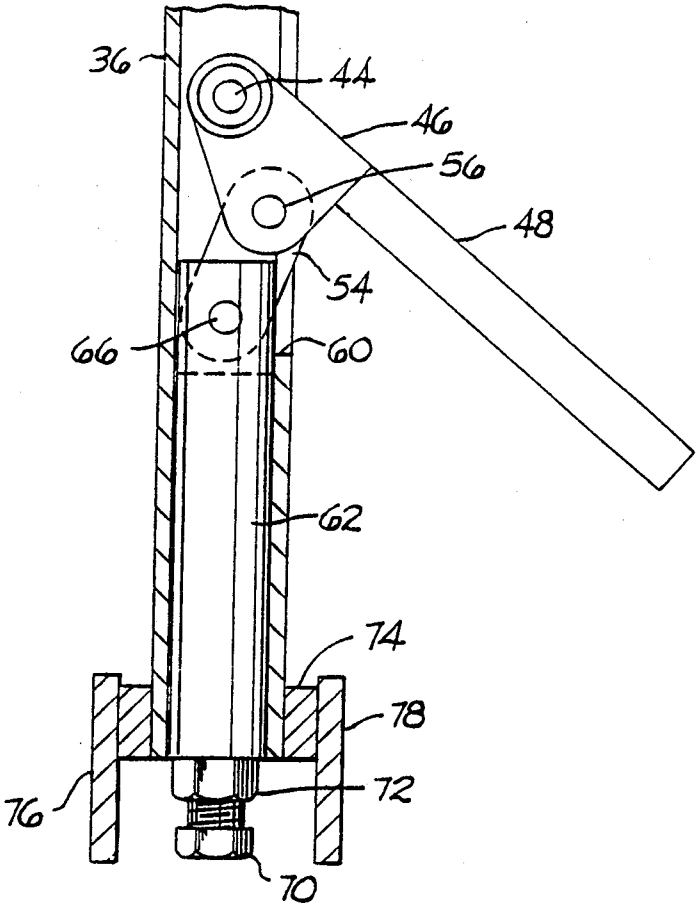
FIG. 4 is a sectional view of the post in the released position.
Figure 3:
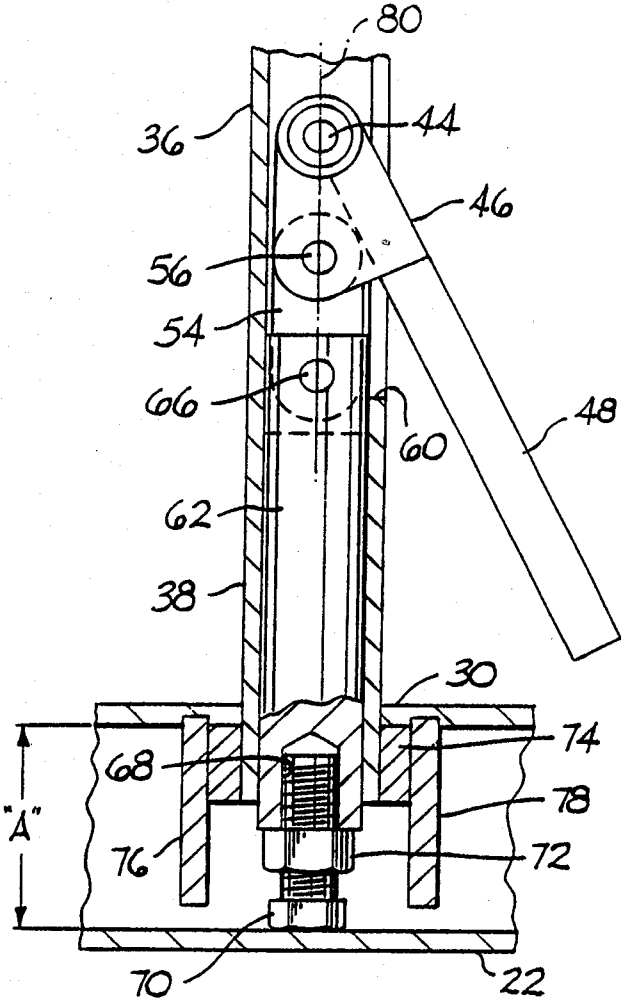
FIG. 3 is a fragmentary enlarged sectional view of a preferred post locked in position.
Figure 5:
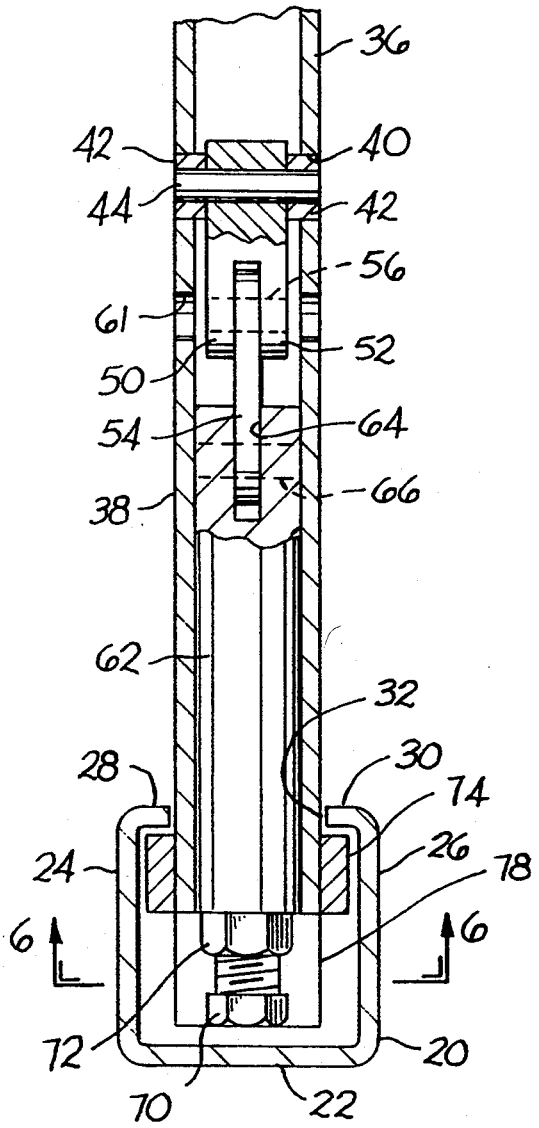
FIG. 5 is a sectional view of the post as seen from the right side of FIG. 4.
Figure 6:
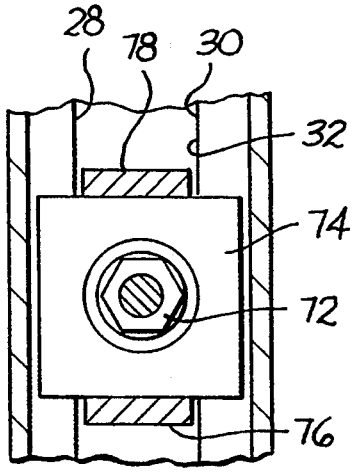
FIG. 6 is a sectional view of the post as seen along lines 6—6 of FIG. 5.

A load 34, illustrated fragmentarily in FIGS. 1 and 2, comprises a stacked of rectangular metal stampings, either steel or aluminum. The stampings are deposited on the pallet tracks in the area circumscribed by four upstanding identically shaped posts 36. A substantial length of each post is in contact with the edges of the stack of stampings to prevent them from horizontally shifting from their stacked position. A typical post includes a vertical steel tubular body 38. Cap 40 closes off the upper end of the body, as illustrated in FIG. 2. Referring to FIGS. 3–5, the post has a pair of horizontally aligned openings 40. A bushing 42 is mounted in each opening 40.

Pivot pin 44 has its ends supported on bushings 42. A clevis 46 is pivotally mounted on pin 44. A rod-like handle 48 is welded to the clevis so the handle can be swung about the axis of pin 44. Clevis 48 has a pair of spaced fingers 50 and 52, best illustrated in FIG. 5. A link 54 is pivotally connected to the clevis fingers by pin 56. Link 54 is disposed inside the tubular body and is raised and lowered by swinging handle 48 between a lower position, illustrated in FIG. 3, and a raised position illustrated in FIG. 4. The clevis and the handle extend through side opening 60 of the body.

A pair of aligned openings 61 in the body permit access to pin 56 as best shown in FIG. 5.

An elongated metal plunger 62 is slideably mounted in the lower end of the tubular body. The upper end of plunger 62 has a longitudinal slot 64. The lower end of link 54 is received in slot 64. Pin 66 pivotally connects the lower end of the link to the upper end of plunger 62. Handle 48 raises and lowers the plunger as the handle is swung between its upper and lower positions.

The lower end of the plunger has a tapped opening 68, as illustrated in FIG. 3. A cap screw (jack screw) 70 is threadably mounted in the tapped opening. By rotating the cap screw, the overall length of the connector and the cap screw can be either increased or reduced. A lock nut 72 locks the cap screw in a desired position.

A square metal collar 74 is welded around the lower end of the tubular body. The collar has a width greater than the width of the track slot 32. A pair of plate-like vertical legs 76 and 78 are welded to opposite sides of the collar. The height of the legs is less than the internal height of the track channel illustrated at "A" in FIG. 3. The width of the legs is less than the width of the slot.

In use, the position of the head 70 of the cap screw is located to accommodate the internal height of the track. The lower end of the post body with collar 74 and the cap screw are inserted in the end of the track in a relatively loose position with handle 48 in its raised position and the lower end of plunger 62 generally flush with the lower end of the tubular body. The post is horizontally located along the track to a position accommodating the edge of the stacked stampings.

The user then lowers handle 48 which causes the link to pivot around pin 66 until the axis of pin 56 is generally vertically aligned with the axes of pin 44 and pin 66 in a plane generally indicated at 80.

The handle is swung downwardly to initially push the plunger away from pivot pin 44, until the cap screw abuts the bottom wall of track 22. As the user continues to lower handle 48, pin 44 raises the tubular body upwardly until the collar abuts the under surface of lips 28 and 30.

The cap screw is adjusted so that as the user completes the downward swinging motion, the collar cooperates with the cap screw to tightly look the lower end of the post in the track channel. The user relocates the post by raising handle 48, horizontally moving the post along the track to a different position and then lowering the handle to lock the post in position. He can readily accommodate a track having a slightly different internal height by adjusting the cap screw and locking it with lock nut 72.

Having described my invention, I claim:

1. A pallet for supporting a plurality of similarly shaped parts piled one above the other in a stacked condition, the parts having a common edge orientation when in the stacked condition, said pallet comprising:

a pallet base comprising a plurality of elongated hollow tracks, each track having a horizontal flat upper wall having a slot, and an underside, and a track base below the slot;

a plurality of vertical posts supported on said base, each post having a lower end disposed in the slot of one of said tracks, and an upper end elevated above said pallet base, said posts being horizontally adjustable along the associated tracks, whereby the posts can be shifted along the tracks to engage the edges of stacked parts to prevent dislocation of an individual part from the stack;

a jack mechanism carried by each post for releasably connecting said post to the associated track, each jack mechanism comprising collar means mounted on the post and located within the associated track for engaging the underside of the upper wall;

an elongated plunger means disposed in the post for engaging the track base;

a manual handle and pivot means for pivotally mounting the handle on the post above the plunger means; and a link trained between the handle and the plunger means;

whereby swinging the handle around said pivot means causes the plunger means to engage the track base and the collar means to engage the underside of the track's upper wall to lock the post in an upright position on the track.

2. The pallet of claim 1, wherein each post comprises a hollow tubular member.

3. The pallet of claim 2, wherein each plunger means comprises an elongated plunger member slidably disposed in the post, and a screw threadably mounted on the lower end of the plunger member to accommodate the distance between the underside of the upper wall and the track base.

4. The pallet of claim 1, and including a pair of legs carried on the collar means and disposed on opposite sides of the lower end of the post.

5. The pallet of claim 1, including first means connecting one end of the link to the handle, and second means connecting an opposite end of the link to the plunger means in a position between the pivot means for the handle, and the lower end of the post.

6. The pallet of claim 1, wherein the post is hollow and the plunger means comprises a vertical bar located on the central axis of the post; the link has a first pivotal connection with said vertical bar, and a second pivotal connection with the handle located so that during a swinging motion of the handle, the first and the second pivotal connections are disposed in a plane passing through the pivotal connection of the handle with the post.

7. A locator post assembly, in combination with a pallet having a base adapted to support a stack of parts, comprising:

a plurality of vertical posts supported on a pallet base having a plurality of elongated hollow tracks, each track comprising an upper horizontal flat wall having an underside and a track slot therein and a track base beneath the slot, each post having a lower end disposed in the slot of one of the tracks and an upper end elevated above said track base, said posts being horizontally adjustable along the associated tracks, whereby the posts can be shifted along the tracks to engage the edges of a stack of parts to prevent dislocation of the parts from the stack; and a locking mechanism carried by each post for releasably connecting the post to the associated track, each locking mechanism comprising collar means carried on the post and located within the associated track beneath the horizontal flat wall, a plunger carried on the post and disposed upwardly in the track slot, a manual handle pivotally mounted on the post above the plunger, and a link trained between the handle and the plunger;

whereby swinging of the handle around said pivotal mounting causes the plunger to engage the base of the track and the collar means to engage the underside of the horizontal flat wall to lock the post on the track.

8. A locator post assembly, in combination with a pallet having a base adapted to support a stack of parts, comprising:

a plurality of hollow vertical posts supported on a pallet base having a plurality of elongated hollow tracks;

each track comprising an horizontal flat upper wall having a track slot therein and a track base beneath the slot;

each post having a lower end disposed in the slot of one of the tracks and an upper end elevated above said pallet base, said posts being horizontally adjustable along the associated tracks, whereby the posts can be shifted along the tracks to engage the edges of a stack of parts to prevent dislocation of the parts from the stack;

a locking mechanism carried by each post for releasably connecting the post to the associated track, each locking mechanism comprising:

collar means carried on the post and located within the associated track beneath the horizontal flat wall, a plunger slidably disposed in the post;

adjustable means mounted on the lower end of the plunger to accommodate the distance between the underside of the upper wall and the track base;

a manual handle pivotally mounted on the post above the plunger; and structure connecting the handle to the plunger;

whereby raising the handle around said pivotal mounting raises the collar means to engage the underside of the horizontal flat wall and lowers the adjustable means to engage the base of the track to lock the post to the track in an upright position.

* * * * *